United States Patent [19]

Matts

[11] Patent Number: 4,490,159

[45] Date of Patent: Dec. 25, 1984

[54] SYSTEM AND METHOD FOR CONTROLLING ENERGIZATION OF ELECTRODES IN ELECTROSTATIC DUST SEPARATORS

[75] Inventor: Sigvard Matts, Växjö, Sweden

[73] Assignee: Flakt Aktiebolag, Nacka, Sweden

[21] Appl. No.: 476,217

[22] Filed: Mar. 17, 1983

[30] Foreign Application Priority Data

Mar. 25, 1982 [SE] Sweden ..... 8201907

[51] Int. Cl.[3] ..... B03C 3/68

[52] U.S. Cl. ..... 55/2; 55/106; 55/139; 361/235; 323/903

[58] Field of Search ..... 55/4, 105, 106, 139, 55/2; 361/235; 323/903; 364/480, 492

[56] References Cited

U.S. PATENT DOCUMENTS

| | | | |
|---|---|---|---|
| 2,724,086 | 11/1955 | Lindberg . | |
| 2,978,065 | 4/1961 | Berg . | |
| 4,284,417 | 8/1981 | Reese et al. | 55/105 |
| 4,354,860 | 10/1982 | Herklotz et al. | 55/105 |

FOREIGN PATENT DOCUMENTS

| | | | |
|---|---|---|---|
| 0030321 | 12/1979 | European Pat. Off. . | |
| 0044488 | 1/1982 | European Pat. Off. . | |
| 71592 | 2/1983 | European Pat. Off. | 55/105 |
| 1457091 | 10/1971 | Fed. Rep. of Germany | 55/4 |
| 2949786 | 6/1981 | Fed. Rep. of Germany | 55/106 |
| 2949797 | 6/1981 | Fed. Rep. of Germany . | |
| WO81/02691 | 10/1981 | PCT Int'l Appl. . | |
| 364347 | 11/1973 | U.S.S.R. | 55/105 |

*Primary Examiner*—David L. Lacey

*Attorney, Agent, or Firm*—Dann, Dorfman, Herrell and Skillman

[57] ABSTRACT

A system and method for controlling energy input to a series of electrostatic dust separator devices having a common gas inlet and a common gas outlet. A detector unit is disposed in the gas outlet to detect the dust concentration or evaluate the actual dust loss in the exhausted gas. Energy control circuitry is coupled with each separator device to control the energy input to each separator device. The control circuitry is actuated by an actuating device to first change and then restore the energy input to each of the separator devices in a selected sequence to thereby change and restore the dust concentration in the exhausted gas. Computation circuitry is coupled with the detector unit to compute the change in dust concentration resulting from a certain change in energy input to each of the separator devices in the sequence. Calculator circuitry selects the separator devices producing a desired change in the dust concentration in response to the certain change in energy input to each of the separator devices. The actuating device is coupled with the calculator circuitry and the control circuitry of each separator device to change the energy input to at least one selected separator device producing the desired change in dust concentration.

9 Claims, 5 Drawing Figures

SYSTEM AND METHOD FOR CONTROLLING ENERGIZATION OF ELECTRODES IN ELECTROSTATIC DUST SEPARATORS

TECHNICAL FIELD

The present invention refers to an arrangement for permitting control of the current and/or voltage values supplied to the respective electrode groups in an installation comprising several electrostatic dust separators or electrode groups so that the total current and voltage requirement of the installation can be miminized to give a desired dust concentration level or dust loss.

The electrostatic dust separator installation comprising several electrostatic dust separators not only encompasses an installation divided into a plurality of electrode groups, where the current and/or voltage levels or values are controlled in each electrode group but it also encompasses an installation comprising a number of electrostatic dust separators, where the current and/or voltage levels or values are controlled by a control arrangement for each separator.

The installation includes for this purpose a detector unit, which evaluates an actual dust loss, and a control arrangement provided for each electrode group, so arranged that as a function of control signals received the control arrangement raises or lowers the current and/or voltage levels or values for the associated electrode group.

STATE OF THE ART

Electrostatic dust separators are already known and a large number of different designs have been referred to.

Electrostatic dust separators are based on the fundamental principle that the higher the voltage and/or current which is present between the electrodes forming part of the dust separator, the better and the more effective the dust separation. However the voltage and/or the current cannot be excessively high, because flashover will then occur between the electrodes.

If the problem involved is, with the aid of an electrostatic dust separator, to separate out considerable quantities of dust from a flow of a medium, an installation is required consisting of a plurality of electrode groups having a separate electromagnetic feed circuit assigned to each group with associated control equipment. It is advisable to distribute the groups uniformly among one or more flue gas chambers.

It is furthermore customary to actuate the control equipment assigned to the respective electrode groups so that the control arrangement feeds its electrode group at the maximum voltage and/or current to which the electrode group concerned can be subjected without an unacceptable number of flashovers or breakdowns occurring per unit time.

As the overall installation is normally dimensioned with a good margin, if each electrode group functions with a minimum loss of dust so that the dust separation by each electrode group is maximized, the outgoing dust concentration is much lower than that required by the regulations. If all electrode groups are operated with a minimum dust loss or a maximum degree of separation, this signifies results in an energy consumption level exceeding the level which is actually required in the particular case.

Consequently various arrangements and measures have been proposed in order to optimize an installation consisting of several electrode groups and an example of a procedure for optimizing such an installation is described in the German patent specification No. 2949797.

The arrangement referred to here is based on the principle that the power input to the electrostatic filter will, via a signal which is proportional to the power input, be supplied to a controller circuit so as to minimize the energy consumption. Simultaneous signals corresponding to the energy quantities supplied are fed into the controller circuit for the remaining electrostatic dust separators which form part of the installation. By this means the sum of the energy inputs is determined and the controller circuit is adapted so as to be able to minimize the energy sums. The fundamental principle here is that the energy input to the individual electrostatic dust separator is calculated in an iterative manner.

The fundamental idea in the previously known arrangements is to employ the measured outgoing dust concentration in the cleaned gases (dust loss) for controlling the energy supply to the filter. By co-ordinating a reduction in the energy supply to one electrode group with an increase in the energy supplied to another electrode group it is possible, in accordance with previously known designs, to manipulate the various energy inputs in such a way that the total energy to the filter is at an optimum level in relation to the actual and required loss of dust.

REVIEW OF THE PRESENT INVENTION

Technical Problems

As previously mentioned, the co-ordination of a plurality of electrode groups forming part of an electrostatic dust separator installation is an extremely difficult technical problem. Experience has indicated that each electrode group in the installation has a widely differing effect on the outgoing dust loss in the treated gases.

Hence it is a difficult technical problem to create such conditions that it becomes possible to know which electrode, or which electrode among a plurality of electrode groups forming part of an installation, is to be operated in such a way that the overall electrical efficiency of the entire installation is most favorable.

It is a very difficult technical problem to create conditions such that the contribution made by each electrode group to the efficiency of the overall installation can be evaluated so that the conditions exist for being able to control this, and only this, or those and only those electrode groups which can in the optimum manner improve the overall efficiency of the entire installation.

Solutions

The present invention relates to an arrangement, in an installation comprising an electrostatic dust separator consisting of several electrode groups, for facilitating control of the current and/or the voltage levels or values supplied to the respective electrode groups so that the total current and voltage requirements of the installation can be minimized to give a desired dust loss. To permit this it is essential that the installation be provided with a detector unit which evaluates the actual dust loss together a control arrangement for each electrode group which is arranged so that it can raise or lower the current and/or voltage levels or values for the associated electrode group as a function of control signals received by the control arrangement.

In accordance with the present invention an actuating device, which is common to all the electrode groups, is provided which during an initial time period instantaneously changes the actual current and/or voltage supplied to the first electrode group, and evaluates a resulting change from the dust loss in the installation corresponding to the change in the current and/or voltage level and then, stores the change in dust loss. During a second time period the changed current and/or voltage level is restored to the actual level prevailing prior to the alteration. In a third time period the actual current and/or voltage level is changed instantaneously for a second electrode group, and after evaluation of a change in the dust loss in the installation corresponding to the alteration, the change in dust loss for the second group is stored. During a fourth time period the changed current and/or voltage level is restored to the actual level prevailing prior to the change.

The invention includes the possibility of evaluating in this way the effect of a change in energy level supplied to each of the electrode groups on the total dust loss from the installation in the outgoing treated gas.

After evaluation of all electrode groups has been performed, that group or those groups which on evaluation indicate optimum power consumption are allowed to receive altered current and/or voltage levels so that via the actuating device such a changed current and/or voltage level can be supplied as gives rise to a change in the emission to achieve the desired dust loss in the outgoing treated gases.

The invention also indicates the possibility whereby the electrode group or the electrode groups which in combination provide a change in the actual dust loss to the desired dust loss level when a changed current and/or voltage level is applied, are supplied with this level via the actuating device.

Finally the present invention provides the possibility of employing the actuating device to carry out a check on all electrode groups forming the installation so that each electrode group gives the lowest anticipated change in the outgoing dust loss for a certain change in the current and/or voltage level, this giving the advantage that each electrode group comprising the installation is subjected to a periodic repetitive check so that the electrode group which for some reason does not give a minimum anticipated change can be disconnected.

Advantages

The main advantage of the arrangement in accordance with the present invention are that by means of the arrangement it has become possible to check the electrode groups forming part of the installation, on the one hand as regards their function, but mainly concerning the contribution made by the electrode group in changing the dust loss on the part of the entire installation as a function of a certain change in the current and/or voltage level. This in turn gives the advantage that only that electrode group, or those electrode groups, which give the maximum change in dust loss in the response to the selected change in current and/or voltage levels can be permitted to operate with the changed current and/or voltage level.

BRIEF DESCRIPTION OF APPENDED DRAWINGS

A proposed embodiment of an arrangement for facilitating control of the current and/or voltage levels which are supplied to the respective dust separators in an installation comprising several electrode groups, so that the total current and voltage requirements of the installation can be minimized to give a desired dust loss will be described in greater detail by reference to the appended drawings where:

FIG. 1 gives a perspective view of an installation comprising a plurality of electrode groups arranged in a flue gas chamber, with one of the transformer/rectifier units provided for one of the electrode groups shown in exploded form above the electrode group;

Figure 3:
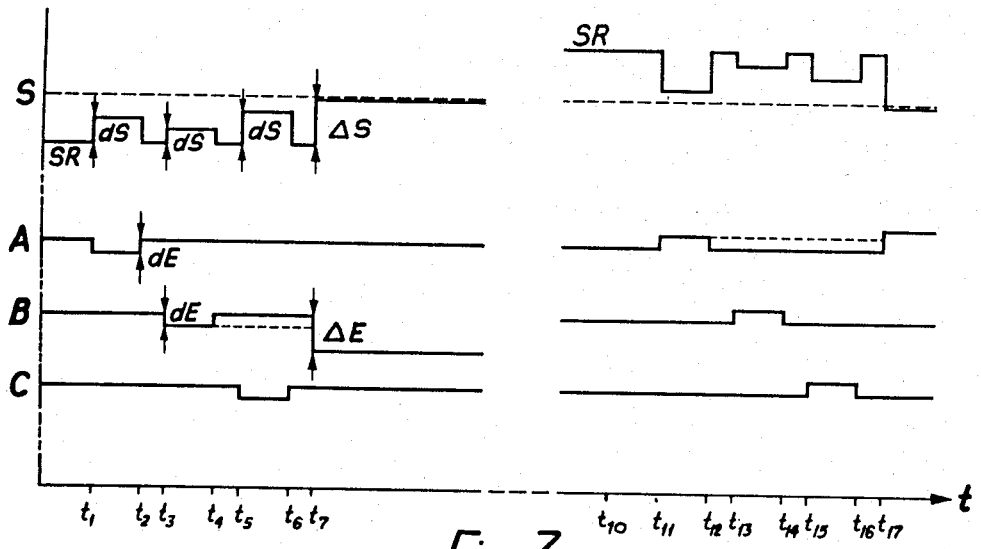
FIG. 3 shows a time diagram illustrating the principles of the present invention.
Figure 3A:
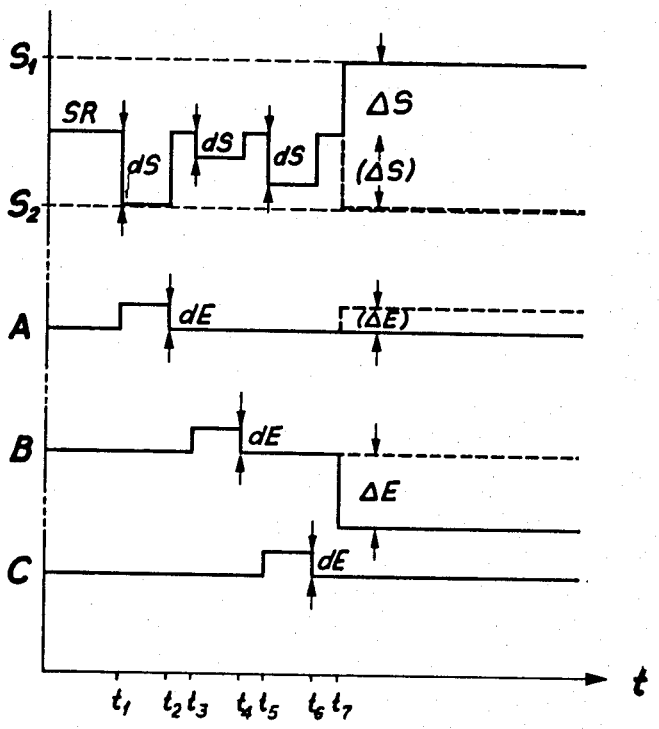

FIG. 3*a* shows a time diagram on a somewhat enlarged scale; and

Figure 4:
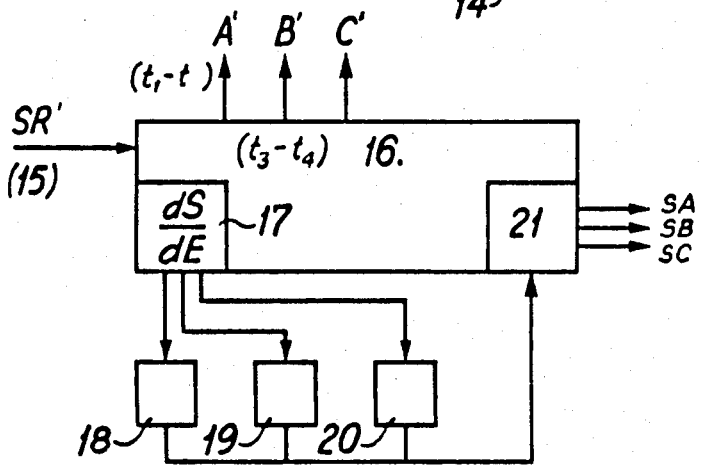

FIG. 4 shows in highly simplified form an actuating device designed to interact with the respective control arrangement for the respective electrode groups.

DESCRIPTION OF THE PROPOSED EMBODIMENT

Figure 1:
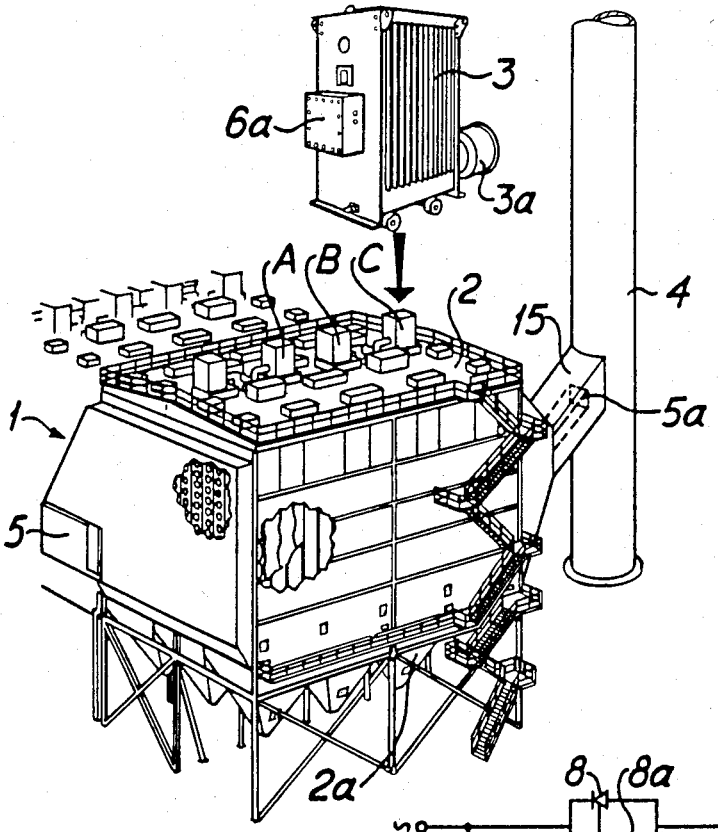

FIG. 1 thus provides a perspective view of an example of an electrostatic dust separator installation 1 consisting of a plurality of parallel flue gas chambers each having four electrostatic separator devices in the form of electrode groups. One transformer/rectifier unit is required for each of these electrode groups, but in FIG. 1 only the unit which is provided for electrode group 1 has been illustrated and this has been given the notation number 3. The location of the electrode groups is fundamentally such that the outlet of one group is connected directly to the inlet of the subsequent group. As group 2 is the last group, illustrated in FIG. 1, its outlet is connected with a chimney stack 4.

Even though an illustration is given here of a dust separator consisting of a number of electrode groups, there is nothing to prevent each group from comprising a separate electrostatic dust separator.

The dust separator installation 1 is of the type where air carrying particles is connected to an inlet 5 and is allowed to pass into the first electrode group. In this group, as in the others, the particles are electrically charged by the electrical field which forms between plate electrodes which are located adjacent to each other with emission electrodes placed between them, by virtue of the fact that a high direct voltage is connected to the emission electrodes. A particle of dust which enters this field becomes electrically negatively charged and this particle is then attracted by the positive plate electrode and repelled by the negative electrode, and consequently particles accumulate at the plates. The air which is cleaned by the electrode groups in turn then passes out through the outlet 5*a* to the stack 4.

As a result of the electrical field, electrically charged dust particles adhere mainly to the plates and form a coating on the plates. When this coating has reached a certain thickness, the coating is rapped mechanically from the plate and drops downwards. Particles collected in the dust separator 2 are therefore normally collected in collection hoppers formed in the base portion 2*a* of the dust separator or in a particle-collection unit.

Figure 2:
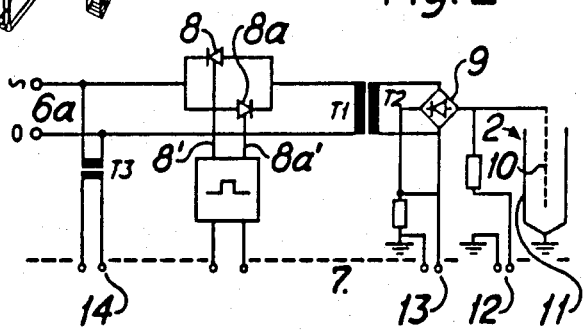
FIG. 2 shows a block diagram of the transformer/-rectifier unit connected to a control arrangement illustrated in phantom.

FIG. 2 illustrates a simplified circuit diagram for a transformer/rectifier unit which shows that a alternating current conductor 6*a* is connected to two thyristors 8, 8*a* connected in opposition. Each thyrister is provided with its own control electrode having conductors 8′ and 8*a*′, which are connected to energy-control circuitry 7 indicated in FIG. 2 but not described in detail.

The control circuit as such is of a type already known and can consist of a control circuit such as is described in detail in U.S. patent application Ser. No. 398,654 of Gustafsson and Matts, commonly owned with this application.

This provides control of the current by means of an inductance forming part of a transformer winding "T1". The transformer winding "T1" interacts with transformer winding "T2" which is connected to a rectifier bridge 9. The negative voltage, which can be regarded as having been rectified and smoothed because of the capacitance which is present between the grounded plate electrode 11 and the emission electrode 10, is connected to the emission electrode 10 in the dust separator 2.

For control of the electrode group or the dust separator, the control circuitry 7 requires information concerning the instantaneous direct voltage and direct current levels. The level of the instantaneous direct voltage can be obtained via a conductor 12 while the instantaneous direct current levels can be obtained via a conductor 13. The passage through zero of the alternating voltage can be evaluated via a conductor 14.

The main task of the control circuitry 7 is to control the signals on conductors 8′ and 8*a*′ in time, by this means permitting regulation of the current and/or voltage levels provided to electrode group 2.

A circuit of the type shown in FIG. 2 is thus connected to each of the different electrode groups which form part of the installation.

It should be stressed that the present invention is not restricted to a certain number of electrode groups forming part of an installation, but with the aim of simplification it is assumed here that there are three groups in the installation, designated A, B and C.

With reference to FIG. 3 the operating sequence of an arrangement must, in an installation 1 consisting of several electrode groups A, B, C, permit regulation of the current and/or voltage levels supplied to the respective groups, so that the total current and voltage requirement for the installation can be minimized for a required loss of dust.

To enable this to be done it is a prerequisite that the installation have the capability to detect the actual dust removal level. A detector unit 15, which evaluates the instantaneous dust concentration or dust losses, is located in the outgoing cleaned gases in the outlet 5*a*. The present invention is based on the fact that any number of detector units can be employed, but with the aim of achieving simplification, only one detector unit which assesses the dust losses has been illustrated. In addition, control circuitry 7, in accordance with FIG. 2, which is associated with each electrode group A, B, C is required and this is arranged so that, dependent on the control signals received, it raises or lowers the current and/or voltage levels for the associated electrode group.

FIG. 3 illustrates, by notation letters A, B, C, the three electrode groups and the change in the energy levels supplied to the electrode groups resulting from the change in the current and/or voltage levels brought about by an actuating device.

The fact that the current and/or voltage levels for electrode groups A, B and C are plotted above each other does not necessarily signify that the levels for the various groups must be different, this procedure having been employed here only to provide increased clarity.

In FIG. 3 the letter "S" denotes a permissible loss of dust or a maximum permissible dust concentration in the outgoing cleaned gases, while the letters "SR" indicate the actual instantaneous dust loss. The letters "dS" illustrate a change in the actual dust loss. The letters "dE" reflect a change in the current and/or voltage level for the dust separator and actually illustrate an energy ramp.

An actuating device 16 which is common to all the electrode groups A, B, C and which will be described in more detail later with reference to FIG. 4 is so arranged that during a first period of times between time "$t_1$" and "$t_2$" the associated energy-control circuitry 7 instantaneously changes the actual current and/or voltage level for an initial group A and, after evaluation of a change in the dust loss "DS" of the installation which corresponds to the change in current and/or voltage, it stores the change in dust loss "DS". During the second period of time, between times "$t_2$" and "$t_3$" the changed current and/or voltage level is restored to the actual level prevailing prior to the alteration for electrode group A.

During a third period of time "$t_3$" and "$t_4$" the energy control circuitry of the actuating device 16 is arranged to instantaneously alter the actual current and/or voltage level for a second group B by the same amount as previously done for group A and, after evaluation of the change in the dust loss "dS" of the installation which corresponds to the alteration, to store the said change, preferably in the actuating device 16.

During a fourth period of time, between times "$t_4$" and "$t_5$" the changed current and/or voltage level is restored to the value prevailing prior to the change.

The same applies to electrode group C.

FIG. 3 shows that "dS" for the change which is allocated to the group B comprises the lowest value, while the change assigned to group C represents the highest value.

In accordance with the invention, after an evaluation has been made for all groups, that group or those groups which give the minimum change in dust loss for an applied change in current and/or voltage level are via the actuating device supplied with a current and/or voltage level which has been altered and preferably calculated in such a way, indicated by "ΔE" at time "$t_7$" that the permissible dust loss "S" is achieved.

It also comes within the framework of the invention that the group or groups which in combination give a change in the actual dust loss to the permitted value in the event of an applied change in current and/or voltage are supplied with the level via the actuating device 16.

The example now shown illustrates how the actual dust loss "SR" is located below the permissible loss limit "S" and there is then a reduction in voltage or current for groups A, B, and C.

If however it should occur that the permissible dust loss "S" is below the actual dust loss "SR", which is illustrated between time periods "$t_{10}$" and "$t_{11}$", the actuating device is arranged to increase the current and/or voltage level for group A and during the time period "$t_{11}$" and "$t_{12}$" a reduction occurs in the dust losses towards the permissible value "S". During the time periods "$t_{13}$" and "$t_{14}$" the increase in current and/or voltage for group B gives rise to a smaller change in the dust loss "SR", the same also applying during the period of time "$t_{15}$" and "$t_{16}$" when group C is subjected to an increase current and/or voltage level.

The evaluation made of the reaction of groups A, B and C to the increase in current and/or voltage shows clearly that with group A the increase gives the maximum effect as regards the loss of dust, so that the actuating device 16 is arranged at time "$t_{17}$" to switch in a higher current and/or voltage level for group A.

FIG. 4 shows in highly simplified form an actuating device 16 which can well include a computer device for controlling the testing procedure, preferably a cyclic testing procedure.

An incoming conductor "SR'" to the actuating device 16 is designed to provide information regarding the actual loss of dust, received from the detector unit 15 which evaluates the loss of dust. Via conductor "A'" an actuating control signal is sent to the control arrangement for group A, which is then arranged, during the time period "$t_1$" and "$t_2$" to bring about a reduction in current and/or voltage. The change in dust loss divided by the change in current and/or voltage reduction, or energy reduction, is evaluated in a unit 17 and is then stored in a memory 18. During the next sequence, i.e. time period "$t_3$" and "$t_4$" the corresponding information for group B is stored in a memory 19. The value obtained during the period of time "$t_5$" and "$t_6$" for group C is stored in unit 20.

When all groups A, B and C are evaluated, all the information stored in memories 18, 19, 20 is transferred to a calculation unit 21 and this calculation unit is arranged via conductor "SC", to transmit an actuating control signal so that the control arrangement provided for group C sets the current and/or voltage level at a level which is below the level previously adjusted by a calculated value "$\Delta E = \Delta S/(ds/dE)$" an modulates the energy input to group C.

Naturally it should also be possible to so arrange the calculation unit 21 that the dust separator or separators which in combination provide a change in the actual dust loss to the desired dust loss value in response to a change in current and/or voltage are supplied with this value via the actuating device.

The actuating device 16 can of course also be arranged to check, via the calculation circuit 21, that all groups give a minimum anticipated change in the dust loss in response to a certain change in the current and/or voltage level.

Even though the actuating device 16 is not shown in detail, this with a view to obtaining simplification, the actuating device 16 should advantageously be capable of controlling the loss of dust in the chimney stack 4 in accordance with the following example.

Let us first assume that the actuating device 16 is to regulate the loss of dust in the stack 4 to the value 50 ($mg/Nm^3$).

Further assume that the actuating device 16 is arranged to increase the power input to one group at a time by 1 kW in order to check what sort of result this increase will produce as regards the change in dust losses.

For an assumed mode of operation it can be assumed that one electrode group results in reduced emission and a reduced dust loss from 55 to 50.

For this group $dS/dE = -5$ ($mg/Nm^3$: kW).

If a cyclic evaluation of the groups in a dust separator during operation is assumed to give the following values for dS/dE:

For the first group $-1$;
For the second group $-1$;
For the third group $-2$;
For the fourth group $-2$;
For the fifth group $-4$;
For the sixth group $-4$;

then these values are stored in memories 18,19, 20 etc. as described previously. If it is further assumed that the actual dust loss is 55, then regulation must take place in order to reduce the loss of dust to a dust loss value of 50.

Taking these values as a basis, in order for the actuating device 16 to be able to reduce the dust loss to the value of 50, the actuating device 16 can be permitted to increase either:

The sixth group by 1.25 kW; from the formula $$\Delta E = \frac{\Delta S}{ds/dE} = \left(\frac{50 - 55}{-4}\right) \text{ or}$$

The fifth group by 1.25 kW; or
The fourth group by 2.5 kW; or
The third group by 2.5 kW; or
The second group by 5 kW; or
The first group by 5 kW.

Hence the actuating device 16 must be capable of evaluating and producing control signals in order to increase the sixth group by 1.25 kW.

If however the sixth group can only cope with an increase of 1 kW due to an excessive number of breakdowns per unit of time with increased power input the actuating device 16 should provide that the sixth group is increased by 1 kW while the fifth group is increasingly 0.25 kW, or alternatively that the sixth and fifth group are each increased by 0.625 kW.

If instead it is assumed that the actual dust loss is 45, it becomes possible to increase the dust loss to 50 by reducing the energy input to different groups in accordance with the information provided above.

In this case the actuating device 16 should reduce the first group by 5 kW or, if this group only uses 3 kW, reduce this group by 3 kW (shut down) and reduce the second group by 2 kW.

In both these embodiments it is obvious that the resulting dust loss value should be located closely to the desired 50 using only one calculating operation and avoiding previously known methods requiring iterative calculations.

FIG. 3*a* shows how the dust loss SR varies with the value dS as a function of an increase in energy dE of similar magnitude in groups A, B and C.

At time $t_7$ the calculation circuit 21, based on previously measured values, has switched in an energy reduction $\Delta E$ for group B, which then gives a dust loss $\Delta S$ which is close to the value S1.

If the calculation circuit 21 switches in an increase in energy ($\Delta E$) for group A, the dust loss ($\Delta S$) will be close to the value S2.

The invention is naturally not restricted to the embodiments quoted above by way of example but can be subjected to modifications within the framework of the following patent claims.

I claim:

1. A system for controlling energy input to each of a number of electrostatic dust separator devices having a gas inlet for receiving a dust-laden gas flow and a gas outlet for exhausting a cleaned gas flow comprising:

detector means adapted to be disposed in the gas outlet for detecting the dust concentration in the exhausted cleaned gas;

control means adapted to be coupled with said separator devices for controlling the energy input to each separator device;

actuator means coupled with the control means for actuating the control means to first change and then restore the energy input to the separator devices in a selected sequence thereby causing a change and restoration of the dust concentration in the exhausted cleaned gas;

computation means coupled with the detector means for computing each change in said dust concentration resulting from said change in energy input to the respective separator devices in the sequence;

calculator means coupled with the computation means for selecting which one of the number of separator devices produces a desired change in dust concentration in response to the change in energy input to the one separator device; and an actuating device coupled with the calculator means and the control means adapted to actuate the control means to change the energy input to the at least one selected separator device for producing said desired change in dust concentration level.

2. The system as set forth in claim 1 wherein the calculator means is constructed so as to calculate a necessary amount of change in energy input to at least one selected separator device to produce a change in dust concentration in the cleaned gas to a preselected dust concentration level, and wherein the actuating device is constructed so as to operate in response to said calculator means to actuate the control means to change the energy input to the selected separator device by said necessary amount.

3. The system as set forth in claim 1 wherein the calculator means is constructed so as to calculate a necessary amount of change in energy input to a selected combination of separator devices to produce a change in dust concentration in the cleaned gas to be preselected dust concentration level, and wherein the actuating device is constructed so as to operate in response to said calculator means to actuate the control means to change the energy input to the selected combination of separator devices by said necessary amount.

4. The system as set forth in claim 1 wherein the calculator means and the actuating device are constructed and arranged so as to provide a maximum decrease in dust concentration level in response to a predetermined increase in energy input to each separator device.

5. The system as set forth in claim 1 wherein the calculator means is constructed so as to calculate a requisite energy input to each separator device to produce a predetermined change in the dust concentration level, and wherein the actuating device is constructed and arranged so as to actuate the control means to supply said requisite energy input to each separator device.

6. A method for controlling energy input to each of a number of electrostatic dust separator devices having a gas inlet for receiving a dust-laden gas flow and a gas outlet for exhausting a cleaned gas flow comprising the steps of:

inputting energy to each of the separator devices;

first changing and then restoring the energy input by a certain amount to each of the separator devices in a selected sequence;

detecting the resulting change in dust concentration in the exhausted gas flow;

storing each change in dust concentration resulting from the change in energy input to each of the respective separator devices;

selecting at least one separator device which produces a desired change in dust concentration in response to the change in energy input to each of the respective separator devices; and changing the energy input to said at least one selected separator device so as to produce the desired change in dust concentration.

7. The method as set forth in claim 6 further comprising the steps of:

calculating the necessary amount of change in energy input to said at least one selected separator device to produce a change in dust concentration in the cleaned gas to achieve a preselected dust concentration level; and changing the energy input to said at least one selected separator device by said necessary amount.

8. The method as set forth in claim 6 further comprising the steps of:

calculating the necessary amount of change in energy input to a selected combination of said separator devices to produce a change in dust concentration in the cleaned gas to achieve a preselected dust concentration level; and changing the energy input to the selected combination of said separator devices by the necessary amount.

9. The method as set forth in claim 6 further comprising the steps of:

calculating a requisite energy input to each of said separator devices so that a predetermined change in energy input to each of said separator devices produces a minimum change in the dust concentration level; and inputting the requisite energy to each of said separator devices.

* * * * *